US005317489A

United States Patent [19]

Delli Gatti et al.

[11] Patent Number: 5,317,489

[45] Date of Patent: May 31, 1994

[54] ILLUMINATED APPARATUS FOR PLAYING A GAME OF HORSESHOES

[76] Inventors: Sal Delli Gatti; Barbara Delli Gatti, both of 50-A Bettlewood Ave., Oaklyn, N.J. 08107; Frank Delli Gatti, 106 Elgin Ave., Westmont, N.J. 08108

[21] Appl. No.: 126,960

[22] Filed: Sep. 22, 1993

[51] Int. Cl.[5] ..... F21V 33/00

[52] U.S. Cl. ..... 362/157; 362/253; 273/427; 446/485

[58] Field of Search ..... 362/109, 157, 253, 351; 273/427, 336, 338, DIG. 24; 446/47, 219, 485

[56] References Cited

U.S. PATENT DOCUMENTS 3,229,976 1/1966 Allen, Jr. ..... 362/253
4,301,616 11/1981 Gudgel ..... 446/47
5,230,650 7/1993 Brayton ..... 446/219

*Primary Examiner*—Richard R. Cole
*Attorney, Agent, or Firm*—Hugh E. Smith

[57] ABSTRACT

An illuminated horseshoe set comprising, in combination a plurality of illuminated horseshoes, each horseshoe including an elongated upper member comprised of an elastomeric material and having a bend adjacent to its center, an elongated lower member comprised of an elastomeric material and having a bend adjacent to its center, a plurality of screws coupling the upper member to the lower member to define a hollow U-shaped member having an upper exterior surface, a lower exterior surface, a major bend adjacent to its center with the major bend aligned with the bends in the upper and lower members, a pair of legs extending in a generally common direction from the major bend with the legs defining a space therebetween, an inner edge located adjacent to the space, an outer edge located remote from the space, and a hole centrally disposed on the outer edge. A translucent strip coupled to the outer edge of the U-shaped member such that it covers the hole, a power source centrally positioned within the U-shaped member, a reflector centrally positioned within the U-shaped member with the reflector having a concave reflective surface facing towards the hole and a central opening therethrough, a lamp positioned in the central opening of the reflector such that light from the lamp is directed by the reflector to illuminate the translucent strip, and a switch disposed on and located flush with the lower exterior surface with the switch coupled between the power source and lamp and operable in one orientation to activate the lamp and in another orientation to deactivate the lamp; and a plurality of illuminated pegs.

4 Claims, 5 Drawing Sheets

FIG. 1
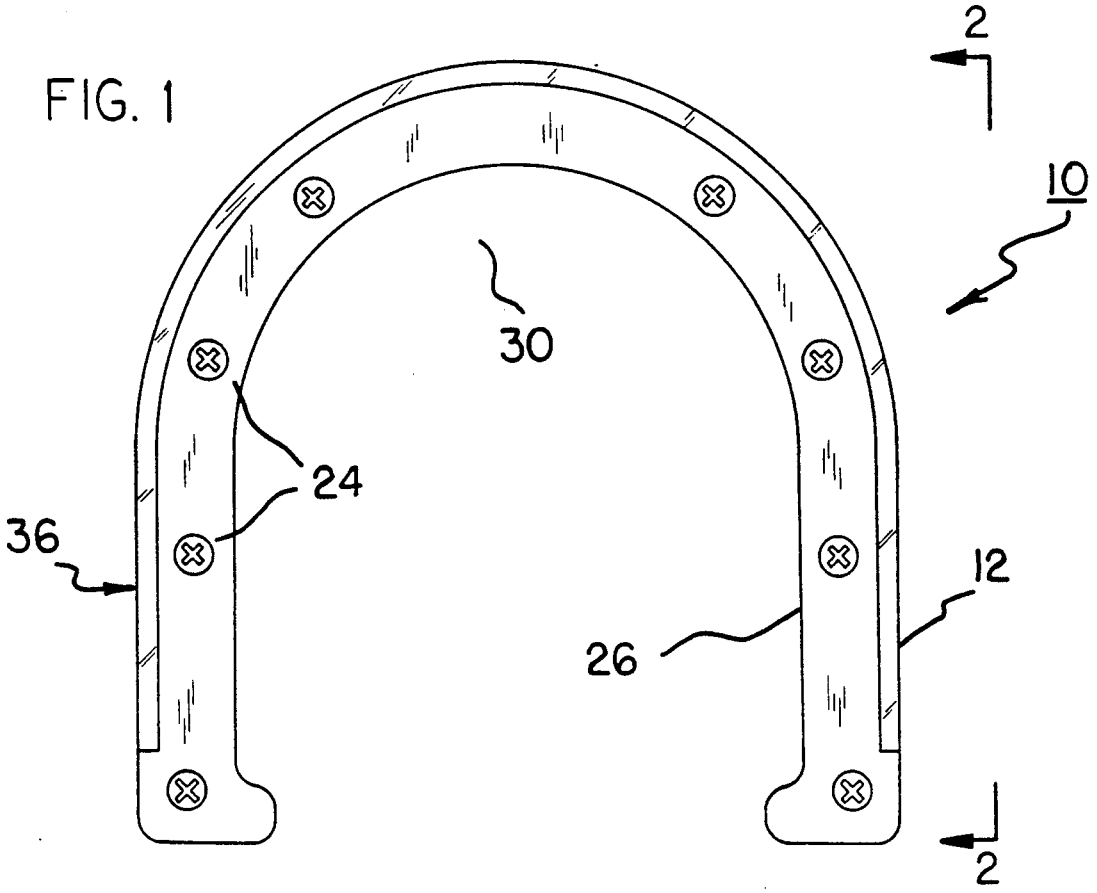
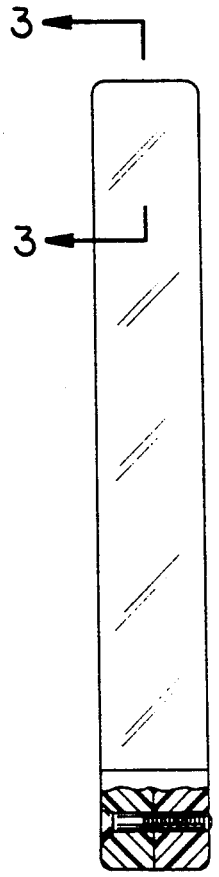
FIG. 2

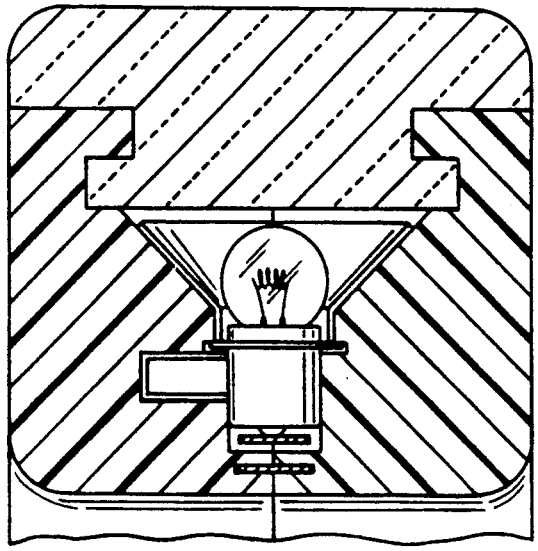
FIG. 5
FIG. 6
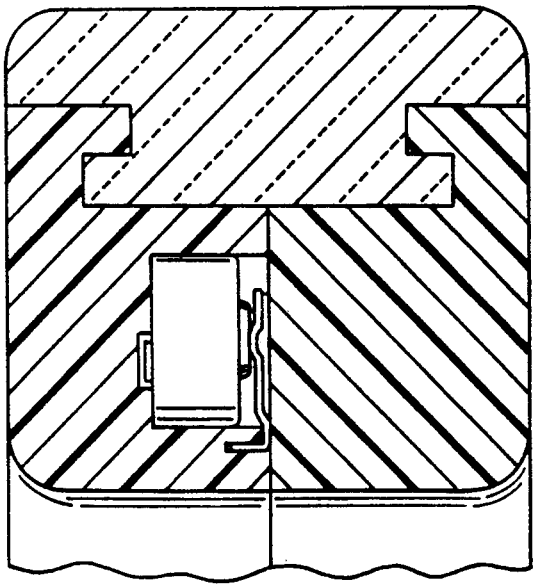

ILLUMINATED APPARATUS FOR PLAYING A GAME OF HORSESHOES

BACKGROUND OF THE INVENTION

1. Field of the Invention

The present invention relates to illuminated apparatus for playing a game of horseshoes and more particularly pertains to games which may be played with horseshoes at night, the games including illuminated horseshoes and illuminated pegs.

2. Description of the Prior Art

The game of horseshoes is known in the prior art. More specifically, horseshoes heretofore devised and utilized for the purpose of playing the game of horseshoes are known to consist basically of familiar, expected and obvious structural configurations, notwithstanding the myriad of designs encompassed by the crowded prior art which have been developed for the fulfillment of countless objectives and requirements.

For example, U.S. Pat. Nos. 4,957,168 to Battista; 4,091,871 to Chiaramonte; 4,580,637 to King; and 3,841,408 to Bucalo describe horseshoes that may be utilized to play a game of horseshoes. King relates to adjustability. The others relate to materials. Furthermore, in this respect, the present invention substantially departs from the conventional concepts and designs of the prior art, and in doing so provides an illuminated apparatus primarily developed for the purpose of playing a game of horseshoes under conditions of limited visibility.

Therefore, it can be appreciated that there exists a continuing need for an improved illuminated apparatus which can be used to play a game of horseshoes. In this regard, the present invention substantially fulfills this need.

SUMMARY OF THE INVENTION

In the view of the foregoing disadvantages inherent in the known types of horseshoes now present in the prior art, the present invention provides and improved illuminated apparatus for playing a game of horseshoes. As such, the general purpose of the present invention, which will be described subsequently in greater detail, is to provide a new and improved illuminated apparatus which has all the advantages of the prior art and none of the disadvantages.

An illuminated horseshoe set comprising, in combination a plurality of illuminated horseshoes, each horseshoe including an elongated upper member comprised of an elastomeric material and having a bend adjacent to its center, an elongated lower member comprised of an elastomeric material and having a bend adjacent to its center, a plurality of screws coupling the upper member to the lower member to define a hollow U-shaped member having an upper exterior surface, a lower exterior surface, a major bend adjacent to its center with the major bend aligned with the bends in the upper and lower members, a pair of legs extending in a generally common direction from the major bend with the legs defining a space therebetween, an inner edge located adjacent to the space, an outer edge located remote from the space, and a hole centrally disposed on the outer edge. A translucent strip is coupled to the outer edge of the U-shaped member such that it covers the hole, a power source centrally positioned within the U-shaped member, a reflector centrally positioned within the U-shaped member with the reflector having a concave reflective surface facing towards the hole and a central opening therethrough, a lamp positioned in the central opening of the reflector such that light from the lamp is directed by the reflector to illuminate the translucent strip, and a switch disposed on and located flush with the lower exterior surface with the switch coupled between the power source and lamp and operable in one orientation to activate the lamp and in another orientation to deactivate the lamp; and a plurality of illuminated pegs, each peg including an elongated hollow shaft comprised of elastomeric material and having a head on one end and a point on the other end with the point adapted to pierce the earth when force is applied to the head, a plurality of aligned holes disposed on the shaft along its central axis, a translucent strip coupled around the shaft, a power source positioned within the shaft, a plurality of lamps, disposed within the shaft and positioned adjacent to a hole such that light from the lamp is directed through the hole to illuminate the translucent strip, a cord coupled to each lamp, the cord and plurality of lamps defining a light source, a switch disposed on the shaft, the switch coupled between the power source and light source and operable in one orientation to activate the light source and in another orientation to deactivate the light source.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved illuminated apparatus for playing a game of horseshoes which has all the advantages of the prior art or devices of a similar nature and none of the disadvantages.

It is another object of the present invention to provide a new and improved illuminated apparatus for playing a game of horseshoes which may be easily and efficiently manufactured and marketed.

It is a further object of the present invention to provide a new and improved illuminated apparatus for playing a game of horseshoes which is of durable and reliable construction.

An even further object of the present invention is to provide a new and improved illuminated apparatus for playing a game of horseshoes which is susceptible of a low cost of manufacture with regard to both materials and labor, and which accordingly is then susceptible of low prices of sale to the consuming public, thereby making such an apparatus economically available to the buying public.

Still yet another object of the present invention is to provide a new and improved illuminated apparatus for playing a game of horseshoes which provides in the apparatuses and methods of the prior art some of the advantages thereof, while simultaneously overcoming some of the disadvantages normally associated therewith.

Still another object of the present invention is to enjoy a game of horseshoes under conditions of limited visibility, particularly at night.

Yet another object of the invention is to illuminate horseshoes and pegs for playing when dark.

Lastly, it is an object of the invention to provide an illuminated horseshoe comprising, in combination a hollow U-shaped member having a major bend adjacent to its center, a pair of legs extending in a generally common direction from the major bend with the legs defining a space therebetween, an inner edge located adjacent to the space, an outer edge located remote from the space, and a plurality of holes disposed on the outer edge; a translucent strip coupled to the outer edge of the U-shaped member such that it covers the holes; a power source positioned within the U-shaped member; a light source positioned in the U-shaped member with the light source adapted for directing light through the holes to illuminate the translucent strip; and a switch disposed on the U-shaped member with the switch coupled between the power source and light source and operable in one orientation to activate the light source and in another orientation to deactivate the light source.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an elevational view of an illuminated horseshoe, constructed in accordance with the principles of the presentation.

FIG. 2 is a side elevational view partly in section of the horseshoes shown in FIG. 1.

FIG. 5 is a sectional view of the lamp with reflector taken along line 5—5 of FIG. 3.

FIG. 6 is a sectional view of the power source taken along line 6—6 of FIG. 3.

DESCRIPTION OF THE PREFERRED EMBODIMENT

Figure 3:
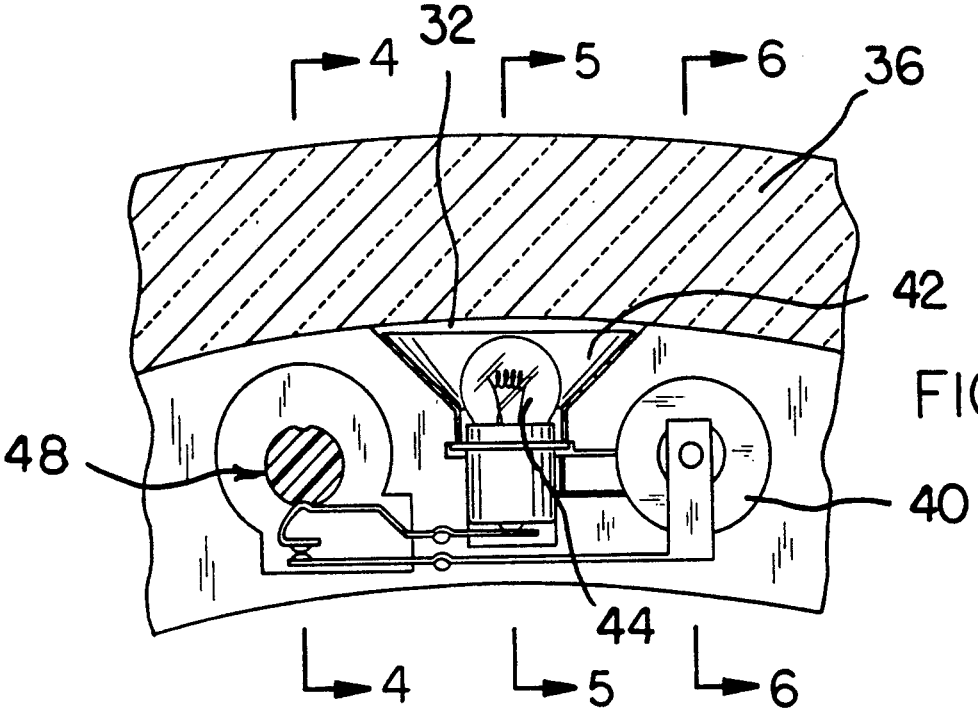
FIG. 3 is a sectional view of the power source, light source, and translucent strip taken along line 3—3 of FIG. 2.
Figure 4:
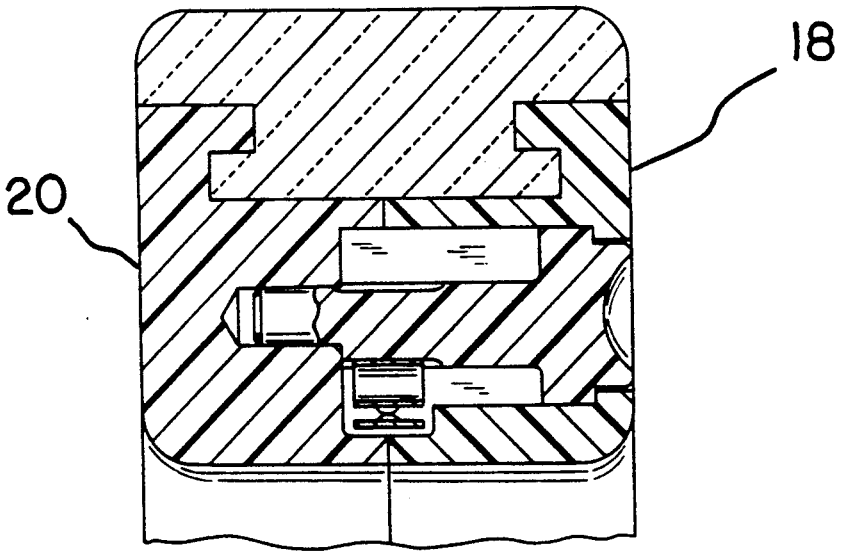
FIG. 4 is a sectional view of the switch taken along line 4—4 of FIG. 3.
Figure 7:
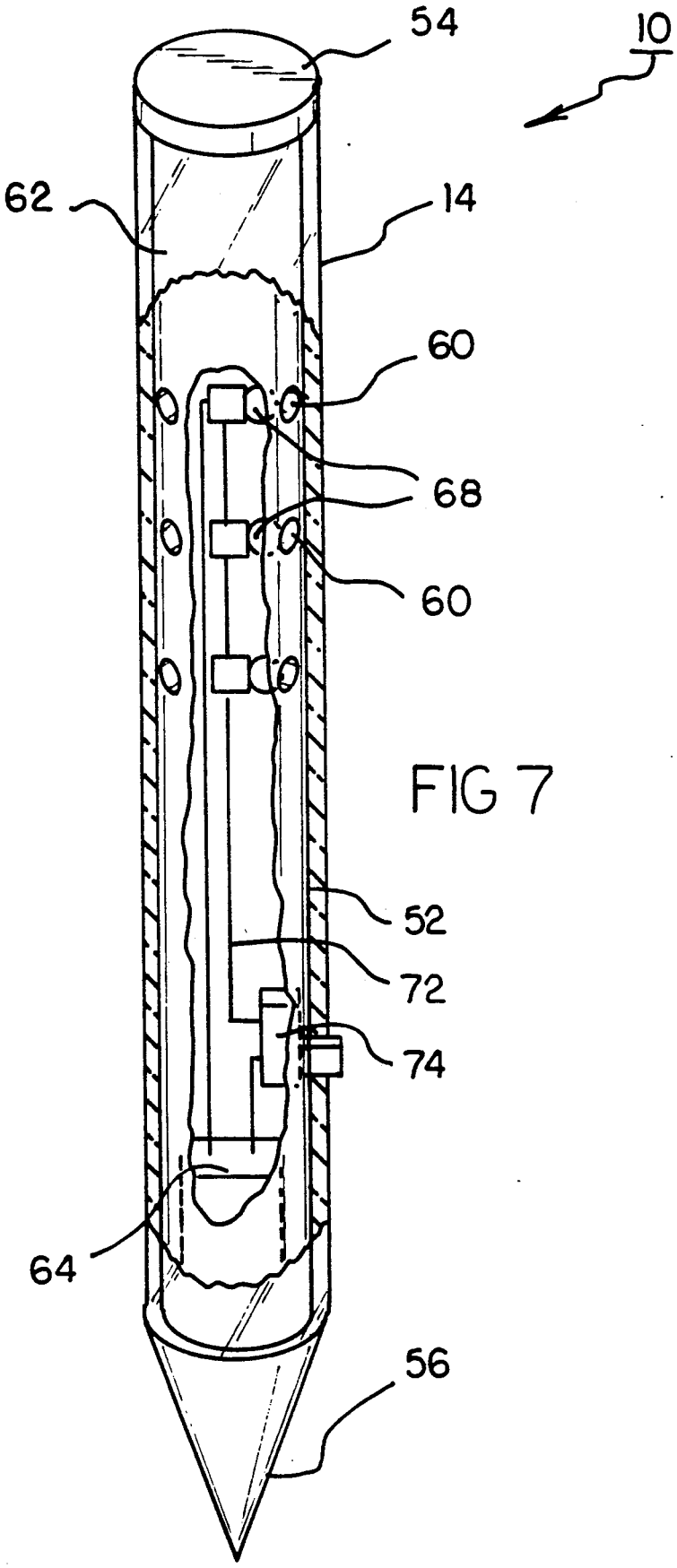
FIG. 7 is an elevational view partly in section of an illuminated horseshoe peg.

With reference now to the drawings, and in particular, to FIGS. 1 through 7 as well as 8—8 for the alternate embodiment, thereof, a new and improved illuminated apparatus for playing a game of horseshoes under conditions of limited visibility embodying the principles and concepts of the present invention and generally designated by the reference number 10 will be described.

As to the manner of usage and operation of the present invention, the same should be apparent from the above description. Accordingly, no further discussion relating to the manner of usage and operation will be provided.

The apparatus 10 includes a plurality of illuminated horseshoes 12 and pegs 14. Each horseshoe includes an elongated upper member 18 comprised of an elastramic material, plastic or rubber, and has a bend adjacent to its center. Each horseshoe also includes an elongated lower member 20 comprised of an elastomeric material, plastic or rubber, and having a bend adjacent to its center. A plurality of screws coupling the upper member to the lower member to define a hollow U-shaped member 26.

The U-shaped member 26 has an upper exterior surface, a lower exterior surface, and a major bend adjacent to its center. The major bend aligned with the bends in the upper and lower members. A pair of legs extend in a generally common direction from the major bend for defining a space 30 therebetween. An inner edge is located adjacent to the space. An outer edge is located remote from the space. A hole 32 is centrally disposed on the outer edge.

A translucent strip 35 is coupled to the outer edge of the U-shaped member 26 such that it covers the hole 32. Centrally positioned within U-shaped members are power source 48, reflector 42 and lamp 44. The reflector 42 has a concave chambers 38 formed in reflective surface facing towards the hole 32 and a central opening therethrough. The lamp 44 is positioned such that light from the lamp is directed by the reflector to illuminate the translucent strip 36. A switch 48 is disposed on and located flush with the lower exterior surface. The switch 48 is coupled between the power source and lamp and operable in one orientation to activate the lamp 44 and in another orientation to deactivate the lamp 44.

Used in playing the game, in addition to the horseshoes 12 are pegs 14. Each peg 14 includes an elongated hollow shelf 52 comprised of an elastomeric material, plastic or rubber. Each shaft 52 has a head 54 on one end and a point 56 on the other end. the point 56 adapted to the pierce the earth when force is applied to the head 54.

A plurality of aligned holes 60 are disposed on the shaft along its central axis. A translucent strip 62 is coupled around the shaft, and a power source 64 is positioned within the shaft.

A plurality of lamps 68 are disposed within the shaft 52. Each lamp 68 is positioned adjacent to a hole 60 such that light from the lamp is directed through the hole to illuminate the translucent strip 62.

A cord 72 is coupled to each lamp 68 such that the cord 72 and the plurality of lamps 68 define a light source. A switch 74 is disposed in the shaft 52 and coupled between the power source 64 and light source. The switch 74 is operable in one orientation to activate the light source and in another orientation to deactivate the light source.

Figure 8:
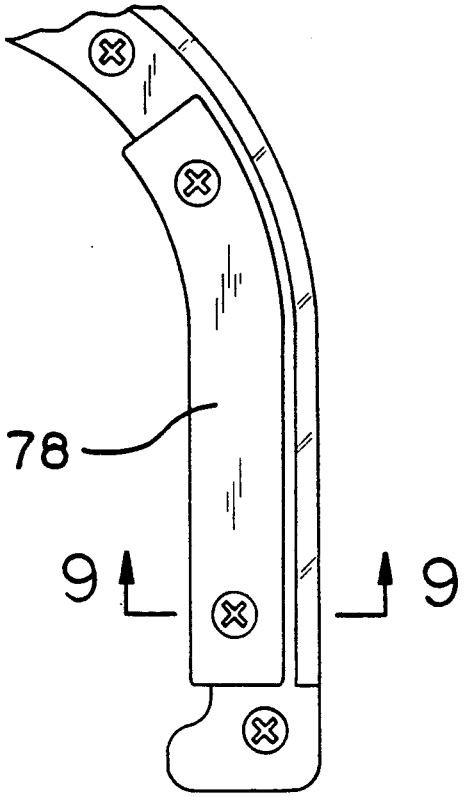
FIG. 8 is an enlarged elevational view of the supplemental weights employed in accordance with an after note embodiment of the invention.
Figure 9:
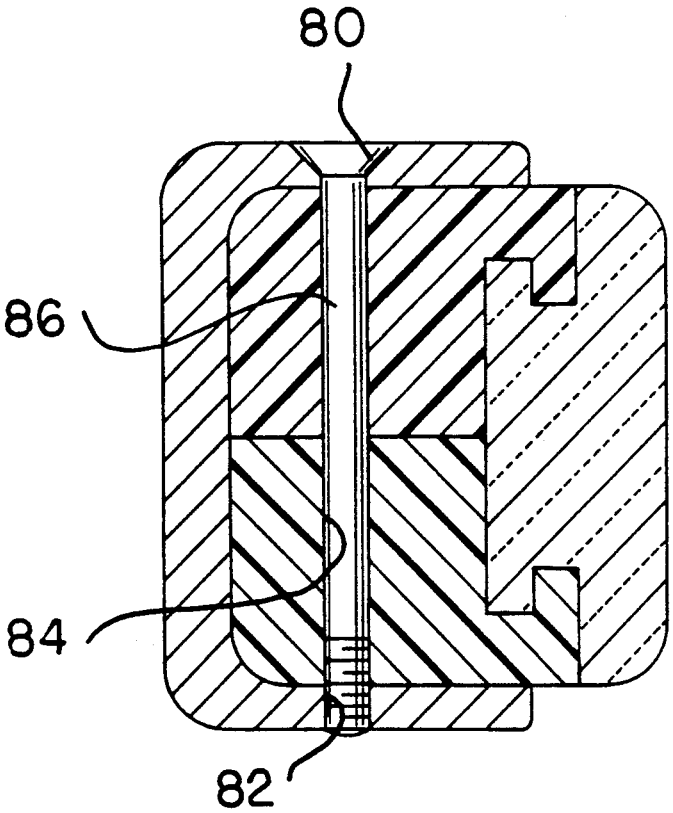
FIG. 9 is a sectional view of the supplemental weights when coupled to the U-shaped member taken along, line 9—9 of FIG. 8.

An alternate embodiment of the invention is shown in FIGS. 8 and 9. According to the alternate embodiment, supplemental weights 78 are utilized. The supplemental weights 78 are preferably provided in pairs, one for each leg of a horseshoe 12. Such weights are eliminated with a U-shaped cross section with aligned holes 80 and 82. The holes are located to align with holes 84 is the horseshoe legs. Holes 80 are beveled. Holes 82 are threaded whereby bolts 8-6 hold the weights in place. Such supplemental weights may be added or omitted or provided at any size or weight at the discretion of a player, man, woman, senior, child, etc. All to enhance the game.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

We claim:

1. An illuminated horseshoe set comprising, in combination:

a hollow U-shaped member having a major bend adjacent to its center, a pair of legs extending in a generally common direction from the major bend with the legs defining a space therebetween, an inner edge located adjacent to the space, an outer edge located remote from the space, and at least one hole disposed on the outer edge;

a translucent strip coupled to the outer edge of the U-shaped member such that it covers the at least one hole;

a power source positioned within the U-shaped member;

a light source positioned in the U-shaped member with the light source adapted for directing light through the at least one hole to illuminate the translucent strip; and a switch disposed on the U-shaped member with the switch coupled between the power source and light source and operable in one orientation to activate the light source and in another orientation to deactivate the light source.

2. The illuminated horseshoe set as set forth in claim 1 and further including:

a hollow shaft having a head on one end and a point on the other end with the point adapted to pierce the earth when force is applied to the head;

a plurality of holes disposed on the shaft;

a translucent strip coupled to the shaft;

a power source positioned within the shaft;

a light source positioned in the shaft with the light source adapted for directing light through the holes to illuminate the translucent strip; and a switch disposed on the peg with the switch coupled between the power source and light source and operable in one orientation to activate the light source and in another orientation to deactivate the light source.

3. An illuminated horseshoe set comprising, in combination:

a. a plurality of illuminated horseshoes, each horseshoe including:

(i) an elongated upper member comprised of an elastomeric material and having a bend adjacent to its center, (ii) an elongated lower member comprised of an elastomeric material and having a bend adjacent to its center, (iii) a plurality of screws coupling the upper member to the lower member to define a hollow U-shaped member having: an upper exterior surface, a lower exterior surface, a major bend adjacent to its center with the major bend aligned with the bends in the upper and lower members, a pair of legs extending in a generally common direction from the major bend with the legs defining a space therebetween, an inner edge located adjacent to the space, an outer edge located remote from the space, and a hole centrally disposed on the outer edge.

(iv) a translucent strip coupled to the outer edge of the U-shaped member such that it covers the hole, (v) a power source centrally positioned within the U-shaped member, (vi) a reflector centrally positioned within the U-shaped member with the reflector having a concave reflective surface facing towards the hole and a central opening therethrough, (viii) a lamp positioned in the central opening of the reflector such that light from the lamp is directed by the reflector to illuminate the translucent strip, and (ix) a switch disposed on and located flush with the lower exterior surface with the switch coupled between the power source and lamp and operable in one orientation to activate the lamp and in another orientation to deactivate the lamp; and b. a plurality Of illuminated pegs, each peg including:

(i) an elongated hollow shaft comprised of elastomeric material and having a head on one end and a point on the other end with the point adapted to pierce the earth when force is applied to the head, (ii) a plurality of aligned holes disposed on the shaft along its central axis, (iii) a translucent strip coupled around the shaft, (iv) a power source positioned within the shaft, (v) a plurality of lamps, disposed within the shaft and positioned adjacent to a hole such that light from the lamp is directed through the hole to illuminate the translucent strip, (vi) a cord coupled to each lamp, the cord and plurality of lamps defining a light source, (vii) a switch disposed on the shaft, the switch coupled between the power source and light source and operable in one orientation to activate the light source and in another orientation to deactivate the light source.

4. The illuminated horseshoe set as forth in claim 3, further including:

a plurality of supplemental weights adapted to be coupled to the lower exterior of the U-shaped member by the screws in order to adjust the weight of the horseshoe based upon a player's strength.

* * * * *